US008286454B2

(12) United States Patent
Richardson et al.

(10) Patent No.: US 8,286,454 B2
(45) Date of Patent: Oct. 16, 2012

(54) REVERSIBLE LOCKING DEVICE FOR MERCHANDISE DISPLAY HOOKS

(75) Inventors: Justin A. Richardson, Waxhaw, NC (US); John F. Roberts, Charlotte, NC (US); Michael R. Johnston, Waxhaw, NC (US); Gregory C. Schultz, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 81 days.

(21) Appl. No.: 12/718,065

(22) Filed: Mar. 5, 2010

(65) Prior Publication Data

US 2010/0223965 A1 Sep. 9, 2010

Related U.S. Application Data

(60) Provisional application No. 61/158,022, filed on Mar. 6, 2009.

(51) Int. Cl.
*E05B 73/00* (2006.01)
*E05B 47/00* (2006.01)

(52) U.S. Cl. ..... 70/14; 70/57.1; 70/62; 70/276; 70/413; 211/7

(58) Field of Classification Search ..... 70/14, 57, 70/57.1, 58–63, 276, 413, 462; 211/7, 57.1, 211/59.1; 248/303, 304, 339, 551–553; 292/244, 292/251.5

See application file for complete search history.

(56) References Cited

U.S. PATENT DOCUMENTS

| | | | | |
|---|---|---|---|---|
| 4,289,242 | A * | 9/1981 | Kenyon | 211/4 |
| 5,027,622 | A * | 7/1991 | Hatch et al. | 70/14 |
| 5,259,220 | A * | 11/1993 | Fredrickson | 70/14 |
| 5,275,027 | A * | 1/1994 | Eklof et al. | 70/14 |
| 5,467,620 | A * | 11/1995 | Byrd, Jr. | 70/38 A |
| 5,689,978 | A * | 11/1997 | Eklof et al. | 70/62 |
| 6,393,877 | B1 * | 5/2002 | Church | 70/62 |
| 6,622,979 | B2 | 9/2003 | Valiulis | |
| 6,848,285 | B2 * | 2/2005 | Stroh | 70/57.1 |
| 6,957,555 | B1 | 10/2005 | Nagel et al. | |
| 6,976,695 | B1 * | 12/2005 | Smith, III | 280/507 |
| 7,104,094 | B2 | 9/2006 | Zadak et al. | |
| 7,197,902 | B1 | 4/2007 | Barkdoll | |

(Continued)

OTHER PUBLICATIONS

"First Line Security Solutions Your First Line of Defense Against Theft!", Southern Imperial, Inc., Rockford, IL.

*Primary Examiner* — Lloyd Gall

(74) *Attorney, Agent, or Firm* — Christopher C. Dremann, P.C.

(57) ABSTRACT

A locking device for a merchandise display hook has an upper rod disposed along a longitudinal axis and a lower rod disposed generally parallel to the longitudinal axis and the upper rod. The locking device includes a housing having a vertical slot adapted to receive the upper rod and the lower rod of the display hook. A bayonet is movable between a locked position in which a portion of the bayonet extends into the slot and restricts movement of at least one of the upper rod and the lower rod within the slot, and an unlocked position in which the bayonet does not extend into the slot and thereby permits movement of the upper rod and the lower rod within the slot. An elongate nose depending outwardly from the housing defines a channel that intersects the slot of the housing and receives the upper rod of the display hook with the upper rod and the lower rod disposed within the slot.

20 Claims, 5 Drawing Sheets

U.S. PATENT DOCUMENTS

| | | | | |
|---|---|---|---|---|
| 7,269,983 | B1 * | 9/2007 | Mchatet et al. | 70/14 |
| 7,392,673 | B2 | 7/2008 | Fawcett et al. | |
| 7,566,037 | B2 * | 7/2009 | Vogler | 248/220.31 |
| 7,703,308 | B2 * | 4/2010 | Nagelski | 70/57.1 |
| 7,743,931 | B2 * | 6/2010 | Barkdoll | 211/7 |
| 2005/0029205 | A1 * | 2/2005 | Mansfield et al. | 211/7 |
| 2006/0070410 | A1 * | 4/2006 | Fuss et al. | 70/57.1 |
| 2006/0157431 | A1 * | 7/2006 | Nagelski et al. | 211/54.1 |
| 2007/0062890 | A1 * | 3/2007 | Nagelski et al. | 211/57.1 |
| 2007/0119796 | A1 | 5/2007 | Barkdoll | |
| 2009/0057244 | A1 * | 3/2009 | Conti et al. | 211/7 |
| 2009/0095695 | A1 * | 4/2009 | Moock et al. | 211/57.1 |

* cited by examiner

REVERSIBLE LOCKING DEVICE FOR MERCHANDISE DISPLAY HOOKS

CROSS REFERENCE TO RELATED APPLICATION

This non-provisional application claims the benefit of priority of U.S. Provisional Patent Application No. 61/158,022, filed on Mar. 6, 2009, the entire disclosure of which is incorporated herein by reference.

FIELD OF THE INVENTION

This invention relates generally to merchandise display hooks for supporting and displaying items of merchandise. More particularly, the invention relates to a locking device for locking items of merchandise on a merchandise display hook wherein the locking device is reversible to accommodate different types of display hooks, while maximizing the number of items that can be supported and displayed on the display hook.

BACKGROUND OF THE INVENTION

It is common practice for retailers to display relatively small, relatively expensive items of merchandise on a merchandise display hook (also known as display rod or display wire) mounted to a generally vertical display support, such as pegboard, slatwall (also known as slat board), horizontal bar or wire grid. The display hook allows a potential purchaser to view an item of merchandise prior to purchase. At the same time, the display hook permits the retailer to display multiple items of merchandise in a limited amount of space, thereby increasing the number of items available on the display support and reducing the need for store personnel to replenish the items. The large number of relatively small and relatively expensive items, however, makes the merchandise an attractive target for shoplifters.

Various locking devices for locking one or more items of merchandise on a merchandise display hook are known. Examples of locking devices that prevent the removal of all items of merchandise displayed on a display hook are shown and described in U.S. Pat. No. 7,104,094 B2 issued to Zadak et al. and entitled Merchandise Lock Bar System And Method; and U.S. Pat. No. 6,622,979 B2 issued to Valiulis and entitled Stem And Scan Locking Hooks. Each of those patents discloses a locking device for a display hook having a forward-extending rod, wherein the locking device is configured to be locked to the end of the rod opposite the display support. Examples of locking devices that prevent the removal of one or more items of merchandise displayed on a display hook are shown and described in U.S. Pat. No. 7,392,673 B2 issued to Fawcett et al. and entitled Lock Mechanism For Display Rod; U.S. Pat. No. 7,197,902 B1 issued to Barkdoll and entitled Display Lock System; and U.S. Pat. No. 6,957,555 B1 issued to Nagel et al. and entitled Locking Attachment For Product Display Hooks. Each of those patents discloses a locking device for a display hook having an upper rod and a lower rod on which the merchandise is suspended, wherein the locking device is configured to be movably retained on the upper rod and unlocked from the lower rod to position the locking device at a desired location relative to the items of merchandise. In this manner, a retailer may prevent a potential purchaser from accessing all or some of the items of merchandise without the assistance of store personnel.

Locking devices for display hooks having an upper rod and a lower rod (commonly referred to as "2-wire" display hooks) may be positioned adjacent the free end of the upper rod with the items of merchandise suspended from the lower rod between the locking device and the display support so as to prevent access to all of the items of merchandise. Alternatively, the locking device may be positioned at a medial location on the upper rod with at least some of the items of merchandise suspended from the lower rod between the locking device and the display support so as to prevent access to some of the items, while permitting the potential purchaser to access the remaining items without the assistance of store personnel. Many different types of 2-wire display hooks are available for use by retailers, and most retailers do not utilize locking devices on all display hooks. Accordingly, display hooks and locking devices are typically purchased separately. However, some of the 2-wire display hooks available to retailers include a lower rod that is shorter in length than the upper rod. As a result, it may be possible to maneuver a conventional locking device along the upper rod past the free end of the lower rod without unlocking the locking device from the lower rod. In this instance, a potential thief would have access to all of the items of merchandise suspended from the lower rod. The body of the locking device may be made thick enough to account for the difference in length between the upper rod and the shorter lower rod. However, the thicker body of the locking device would necessarily reduce the number of items of merchandise that could be displayed on a display hook having an upper rod and a lower rod of substantially equal length.

Accordingly, there exists a need for an improved locking device for locking items of merchandise on a merchandise display hook. There exists a further and more specific need for a locking device that is useable with a display hook having an upper rod and a lower rod of substantially equal length as well as a display hook having an upper rod and a lower that is shorter than the upper rod. There exists yet a further and more particular need for a locking device that accommodates a display hook having an upper rod and a lower rod that is shorter than the upper rod, while maximizing the number of items of merchandise that can be suspended from the lower rod and displayed on the display hook.

BRIEF SUMMARY OF THE INVENTION

The aforementioned needs, objectives and advantages, as well as others that will be readily apparent to those of ordinary skill in the art are provided by a reversible locking device according to the invention for locking items of merchandise on a merchandise display hook having an upper rod and a lower rod. The upper rod defines a longitudinal axis and the lower rod is spaced vertically from the upper rod and disposed generally parallel to the longitudinal axis of the upper rod. The locking device is useable with a display hook having an upper rod and a lower rod of substantially equal length as well as a display hook having an upper rod and a lower that is shorter than the upper rod. In particular, the locking device accommodates a display hook having an upper rod and a lower rod that is shorter than the upper rod, while maximizing the number of items of merchandise that can be suspended from the lower rod and displayed on the display hook.

In one aspect the invention is a locking device including a housing, a bayonet disposed at least partially within the housing, and an elongate nose depending outwardly from the housing in the direction of the longitudinal axis of the merchandise display hook. The housing has an elongate vertical slot formed therethrough that is sized and shaped to receive the upper and lower rods of the display hook. The bayonet is movable between a locked position in which a portion of the bayonet extends into the slot and thereby restricts movement of at least one of the upper and lower rods within the slot, and an unlocked position in which the bayonet does not extend into the slot and thereby permits movement of the upper and lower rods within the slot. The elongate nose is disposed about the longitudinal axis defined by the upper rod of the merchandise display hook and forms a channel that intersects the slot of the housing. The channel is sized and shaped to receive the upper rod of the display hook therein with the upper and lower rods disposed within the slot of the housing.

In one embodiment, the nose includes an elongate upper portion and an elongate lower portion. The upper portion depends outwardly from the housing, is disposed along the longitudinal axis, and is adapted to receive the upper rod therein. The lower portion depends outwardly from the bayonet, is disposed parallel to the upper portion of the nose, and slidably engages the upper portion of the nose. The locking device may further include a shuttle disposed within the housing and movable between an engaging position in which the shuttle engages the bayonet and thereby prevents movement of the bayonet from the locked position, and a disengaging position in which the shuttle disengages the bayonet and thereby permits the bayonet to move relative to the housing.

In another embodiment, the bayonet is biased towards the unlocked position by a spring and the shuttle is biased by a spring towards the bayonet and is operated by a magnetic key including a magnet that moves the shuttle from an engaging position in which the shuttle engages the bayonet and a disengaging position in which the shuttle does not engage the bayonet.

BRIEF DESCRIPTION OF THE DRAWINGS

The present invention is better understood with reference to the following detailed description in conjunction with the accompanying drawing figures.

DETAILED DESCRIPTION OF THE INVENTION

Figures 1, 2:
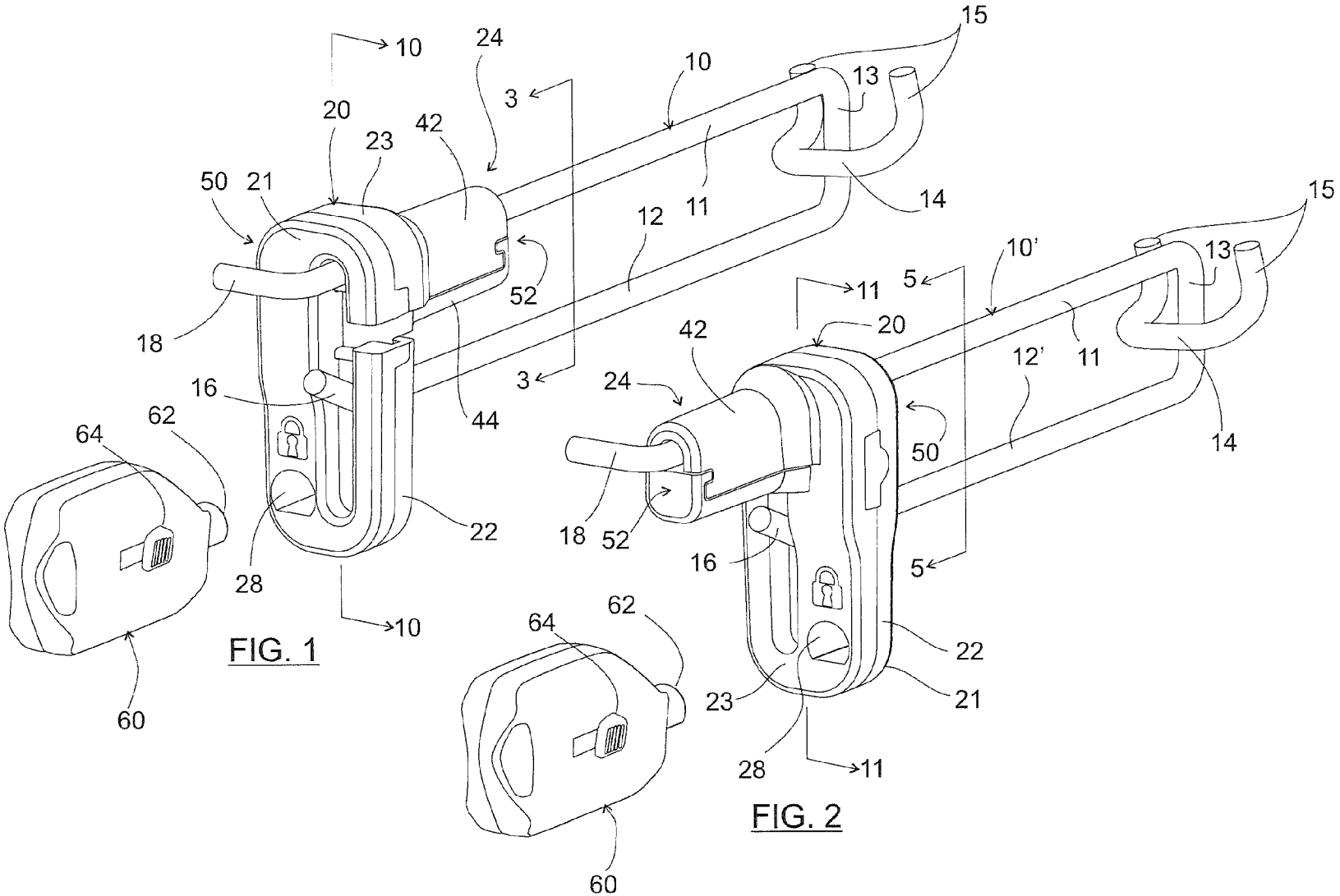
FIG. 1 is a perspective view of a locking device according to the invention shown mounted in a first orientation on a first type of merchandise display hook.
FIG. 2 is a perspective view of the locking device of the invention shown mounted in a second orientation on a second type of merchandise display hook.
Figure 5:
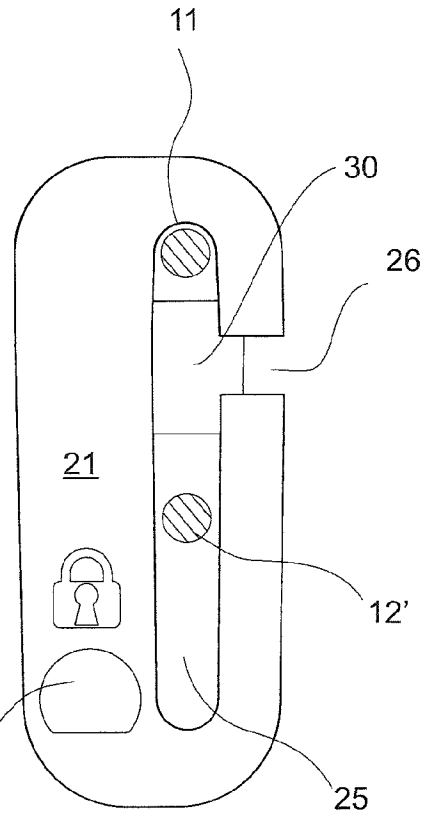
FIG. 5 is an end view of the locking device as shown in FIG. 2 taken in the direction indicated by 5-5, which is opposite to the end view of FIG. 3.
Figure 4:
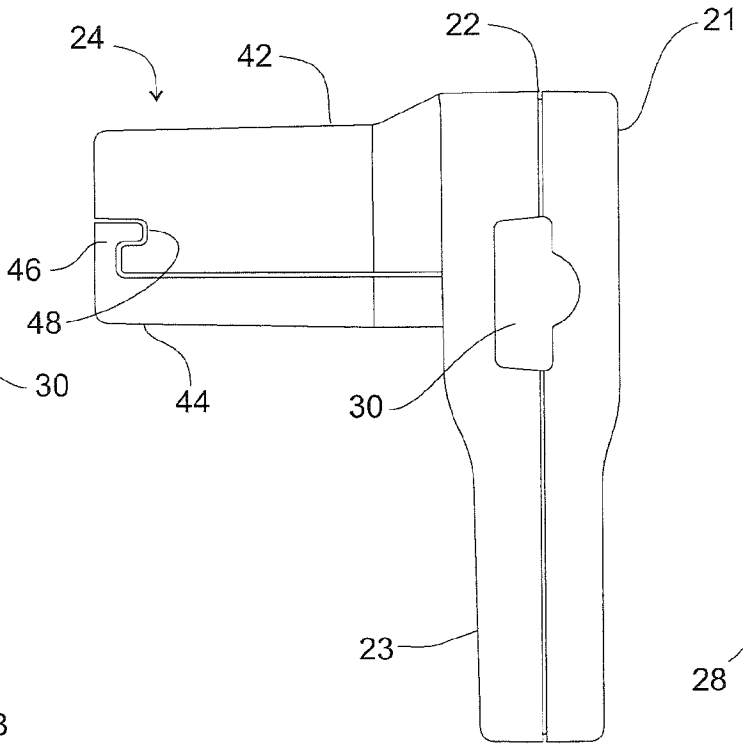
FIG. 4 is a side view of the locking device as shown in FIG. 2.
Figure 3:
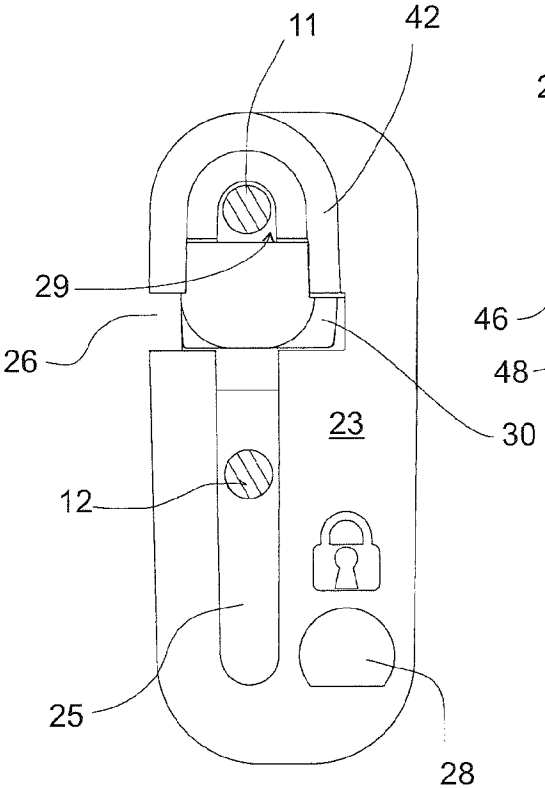
FIG. 3 is an end view of the locking device as shown in FIG. 1 taken in the direction indicated by 3-3.

Referring now to the accompanying drawing figures wherein identical reference numerals denote like elements, an exemplary embodiment of a locking device 20 according to the invention is shown in the various views of FIGS. 1-11. The locking device 20 is reversible for use in a first orientation on a first type of a merchandise display hook 10, and for use in a second orientation on a second type of a merchandise display hook 10'. The locking device 20 is shown mounted in the first orientation on the first type of merchandise display hook 10 in FIG. 1 and FIG. 10. The locking device 20 is shown mounted in the second orientation on the second type of merchandise display hook 10' in FIG. 2 and FIG. 11.

The merchandise display hook 10 and the merchandise display hook 10' each comprise an elongate U-shaped wire formed into a horizontally disposed upper rod 11 and a horizontally disposed lower rod 12 connected by a vertically disposed mounting member 13. A horizontally disposed mounting member 14 may be attached, for example by welding, to the vertically disposed mounting member 13 that terminates in a pair of upwardly depending mounting prongs 15 for mounting the display hook 10, 10' on a display support (not shown). For example, the display support may be a generally vertical wall having a plurality of horizontally and vertically spaced apertures formed therethrough commonly referred to as "pegboard." Alternatively, the mounting prongs 15 may be configured in an alternative known manner to mount the merchandise display hook 10, 10' to a wall comprising vertically spaced slots commonly referred to a slatwall (also known as slat board), to a horizontal bar, or to a horizontal and vertical wire grid with or without a conversion bracket for receiving the mounting prongs.

The upper and lower rods 11 and 12 extend outwardly from the vertical mounting member 13 to define a free end of the merchandise display hook 10, 10' at which items of merchandise (not shown for purposes of clarity) supported on the lower rod 12 are placed onto and removed from hanging engagement with the lower rod when the locking device 20 is unlocked and removed from the display hook, as will be described in greater detail. A vertically upturned (e.g. bent) end portion 16 of the lower rod 12 serves to prevent the items of merchandise from sliding off the lower rod 12 when the locking device 20 is removed from a merchandise display hook 10, 10' that is titled downwards more than slightly relative to horizontal. A horizontally turned out (e.g. bent) end portion 18 of the upper rod 11 serves to prevent removal of the locking device 20 from the display hook 10, 10' when the locking device is locked. As is known in the relevant art, the end portion 18 may also serve as a label holder or as a convenient mount for a label holder. Furthermore, the end portion 18 may comprise a perpendicularly disposed rod attached, for example welded, to the upper rod 11 in a known manner.

The merchandise display hook 10, 10' is suitable for supporting and displaying one or more of the items of merchandise, such as relatively small and relatively expensive consumer products, for example compact discs (CDs), digital video discs (DVDs), battery packs, etc. in packaging suspended from the display hook. More particularly, the items of merchandise are supported on the lower rod 12 of the merchandise display hook 10, 10' while the locking device 20 is primarily supported by the upper rod 11. Typically, multiple merchandise display hooks of the same or different types are mounted on the display support so that a retailer can support and display a large number of the same or different items of merchandise. In this manner, retailers are able to display numerous products in a limited amount of space, and thereby reduce the need to frequently replenish the items. As described in further detail below, the locking device 20 has an unlocked configuration and a locked configuration. In the unlocked configuration, the locking device 20 can be removed from the merchandise display hook 10, 10' so that items of merchandise can be loaded onto (i.e. stocked) and removed off the lower rod 12 of the merchandise display hook. In the locked configuration, the locking device 20 prevents items of merchandise from being removed from the merchandise display hook 10, 10'.

As shown herein, the locking device 20 comprises a closed housing 22 formed by a base 23 and a cover 21 affixed to the base, typically by fusion or a sonic welding process following assembly of the internal components. Once assembled, the base 23 and the cover 21 of the locking device 20 together retain a movable locking bayonet 30. The bayonet 30 is movable between an unlocked position (see FIGS. 6 and 8) and a locked position (see FIGS. 7 and 9) to define the unlocked and locked configurations, respectively, of the locking device 20. In the unlocked position, the bayonet 30 extends partially outward from the housing 22 in a lateral direction and is not disposed within a vertical slot 25 defined by the housing 22 of the locking device 20 such that the bayonet 30 permits movement of the upper and lower rods 11 and 12 (FIG. 8) within the slot 25. As a result, the locking device 20 can be raised relative to the merchandise display hook 10, 10' until the upper rod 11 is positioned adjacent a horizontal slot 26 defined by the housing 22 of the locking device. The upper rod 11 can then be passed out of the vertical slot 25 through the horizontal slot 26 by rotation of the raised locking device 20 relative to the merchandise display hook 10, 10'. The horizontal slot 26 is then positioned adjacent the lower rod 12 of the merchandise display hook 10, 10' by further manipulation of the locking device 20 so that the lower rod can be passed through the horizontal slot to completely remove the locking device from the display hook. The locking device 20 can be re-installed onto the merchandise display hook 10, 10' while in the unlocked configuration in a reverse manner. It is important to note that the locking device 20 is installed and removed from the merchandise display hook 10 and the merchandise display hook 10' in the same manner with the exception that the orientation of the locking device 20 is reversed.

Figure 7:
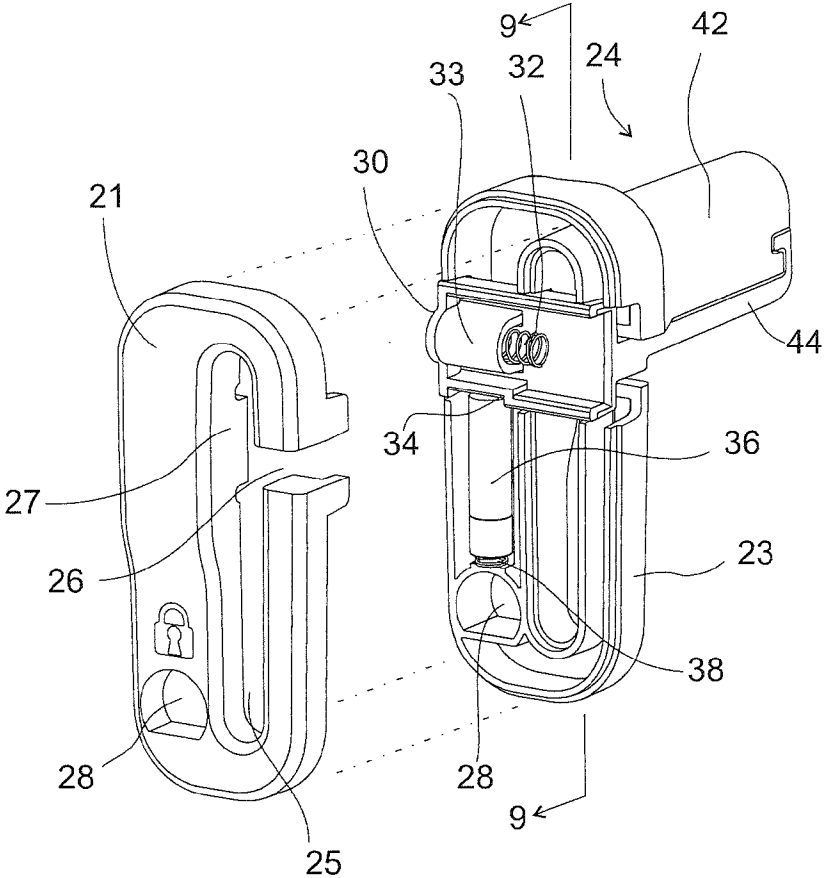
FIG. 7 is an exploded perspective view of the locking device as shown in FIG. 1 with the bayonet in the locked position.
Figure 6:
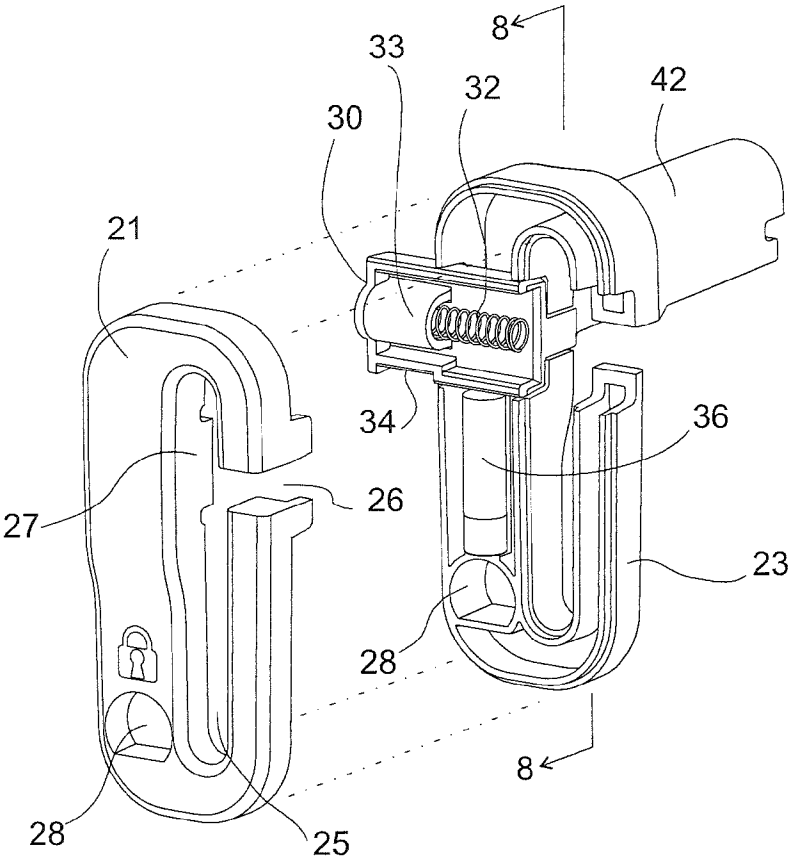
FIG. 6 is an exploded perspective view of the locking device as shown in FIG. 1 with the bayonet in the unlocked position.
Figure 9:
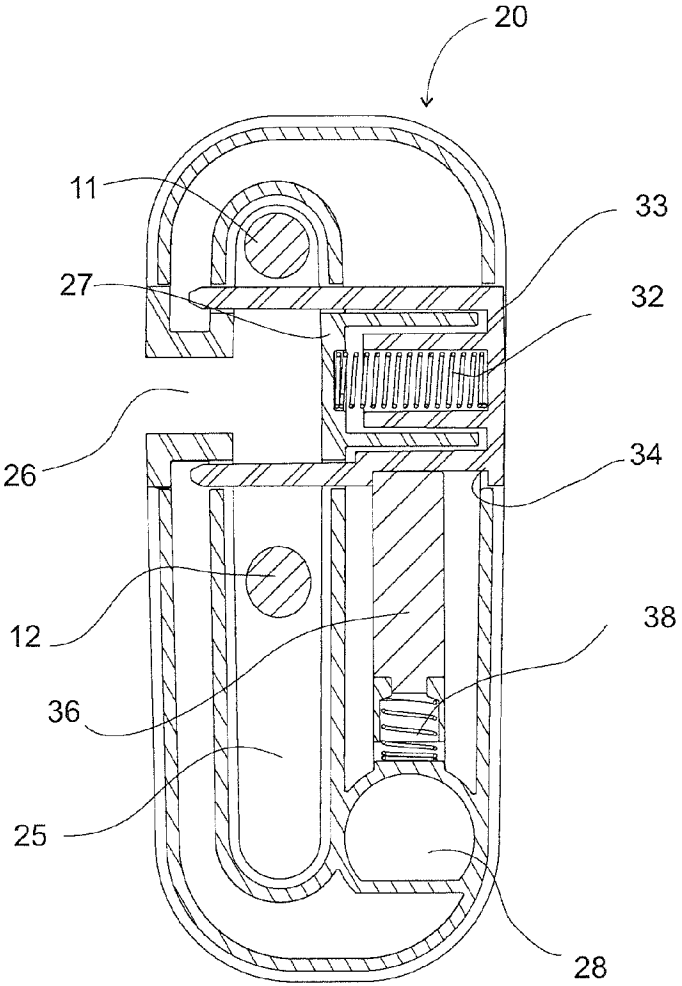
FIG. 9 is a sectional view of the locking device with the bayonet in the locked position taken at the location and in the direction indicated by 9-9 in FIG. 7 and showing an upper rod and a lower rod of a merchandise display hook disposed in the locking device.
Figure 8:
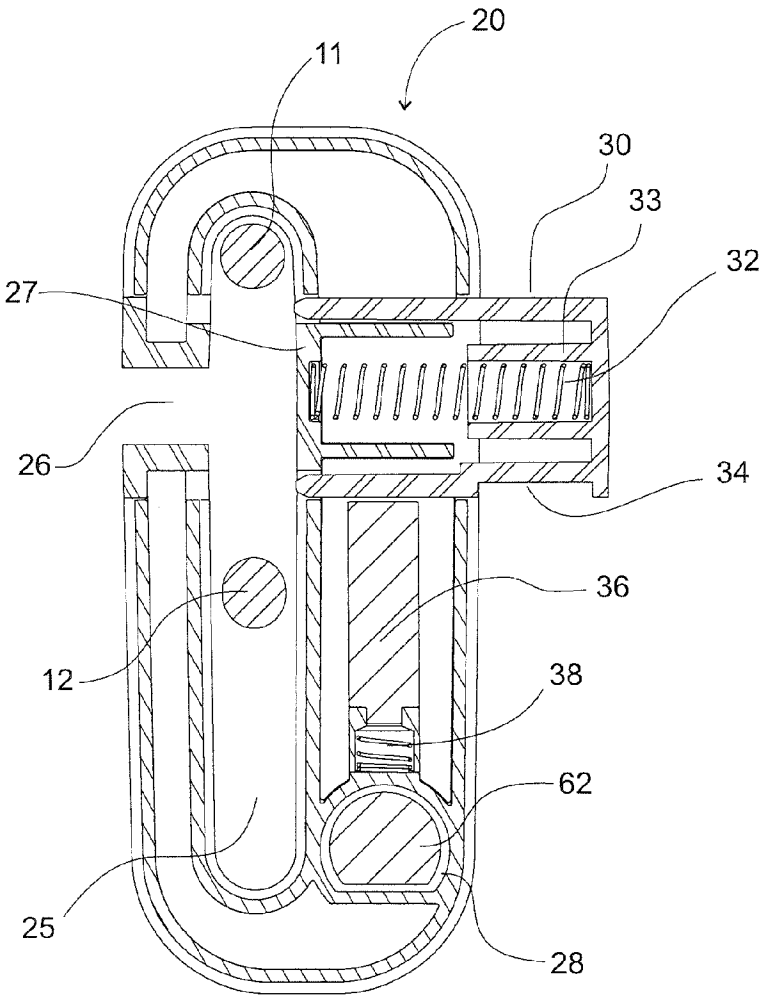
FIG. 8 is a sectional view of the locking device with the bayonet in the unlocked position taken at the location and in the direction indicated by 8-8 in FIG. 6 and showing an upper rod and a lower rod of a merchandise display hook disposed in the locking device.

As best shown in FIGS. 6-9, the bayonet 30 is biased toward the unlocked position by a biasing spring 32 that is fully extended in the unlocked configuration of the locking device 20 (FIGS. 6 and 8) and is compressed in the locked configuration of the locking device 20 (FIGS. 7 and 9). The biasing spring 32 is generally trapped between an indentation, pocket, recess or the like defined in an abutment flange 27 of the cover 21 of the housing 22 and an opposing cup, cavity or pocket 33 formed in the bayonet 30. The abutment flange 27 extends outwardly from and is preferably formed integral with a portion of an inner wall of the cover 21 of the housing 22 that defines one side of the vertical slot 25. The cup 33 extends outwardly from and is preferably formed integral with the bayonet 30. The locking device 20 is locked onto the merchandise display hook 10, 10' with the upper rod 11 and the lower rod 12 positioned within the slot 25 and the bayonet 30 disposed between the upper and lower rods by manually pressing the bayonet 30 against the biasing force of the biasing spring 32 from the unlocked position of the bayonet (FIGS. 6 and 8) to the locked position of the bayonet (FIGS. 7 and 9).

The bayonet 30 is held in the locked position by an elongate shuttle 36 that engages a recess 34 defined by the bayonet, thereby retaining the bayonet in the locked position (FIG. 9). The locked configuration of the locking device 20 is achieved when the bayonet 30 is retained in the locked position as shown in FIG. 9 with the shuttle 36 disposed within the recess 34 of the bayonet. As shown herein, the bayonet 30 and the shuttle 36 are movable relative to the housing 22 along mutually perpendicular axes. However, the bayonet 30 and the shuttle 36 may be configured to move in any desired direction relative to each other and relative to the housing 22 as long as the bayonet serves to prevent at least one of the upper and lower rods 11 and 12 from moving within the vertical slot 25 to a position adjacent the horizontal slot 26. In the preferred embodiment shown herein, the slot 25 of the locking device 20 is disposed vertically and the bayonet 30 moves horizontally when manually pressed from the unlocked position to the locked position until the recess 34 of the bayonet aligns with the shuttle 36. The shuttle 36 then moves vertically to engage the recess 34 and lock the locking device 20 in the locked configuration. In the locked position, opposed legs of the bayonet 30 respectively trap the upper and lower rods 11 and 12 in the vertical slot 25 on opposite sides of the bayonet.

The shuttle 36 is biased into the recess 34 of the bayonet 30 under a biasing force exerted by a biasing spring 38 disposed within the base 23 of the housing 22 with the shuttle 36 positioned between the bayonet 30 and the biasing spring 38. The shuttle 36 is made of a magnetically attractable material, and consequently, is attracted against the biasing force exerted by the biasing spring 38 when a magnetic actuator 62 (e.g. a magnet) of a magnetic key 60 (FIGS. 1-2) is inserted into a cavity or recess 28 defined by the housing 22. As a result of the magnetic attraction force exerted by the magnet 62, the shuttle 36 is moved (i.e. drawn) out of the recess 34 and the bayonet 30 is released to the unlocked position by the biasing force of the biasing spring 32. The unlocked configuration of the locking device 20 is achieved when the bayonet 30 has reached the unlocked position shown in FIG. 8 and the shuttle 36 has withdrawn against the biasing force of the biasing spring 38 to a disengaged position in which the shuttle is disengaged from the recess 34 of the bayonet.

Figure 11:
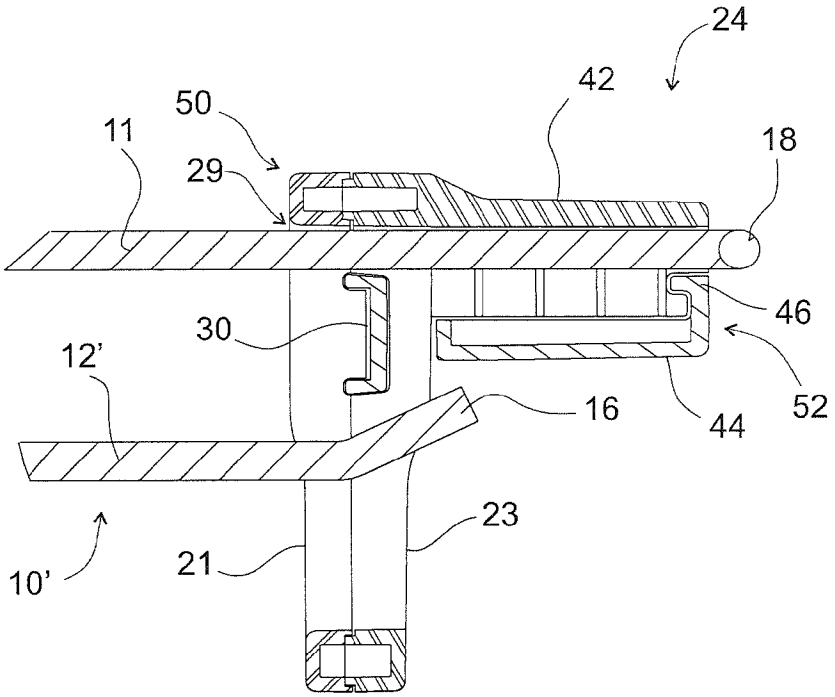
FIG. 11 is a sectional view of the locking device mounted in the second orientation on the second type of merchandise display hook taken at the location and in the direction indicated by 11-11 in FIG. 2 with the bayonet in the locked position.
Figure 10:
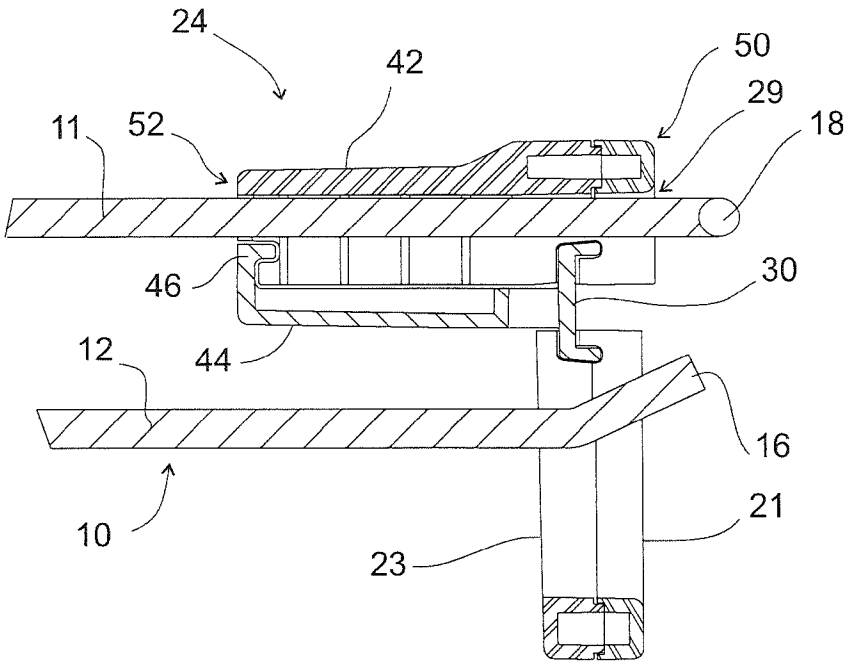
FIG. 10 is a sectional view of the locking device mounted in the first orientation on the first type of merchandise display hook taken at the location and in the direction indicated by 10-10 in FIG. 1 with the bayonet in the locked position.

A nose 24 extends outwardly from the base 23 of the housing 22 opposite the cover 21. As best shown in FIGS. 10 and 11, the nose 24 defines a longitudinally extending internal channel 29 that intersects the upper end of the slot 25 and is sized and shaped to receive the upper rod 11 of the merchandise display hook 10, 10'. The nose 24 has an upper portion 42 that is an integral extension of the base 23 and a lower portion 44 that is an integral extension of the bayonet 30. Thus, the lower portion 44 of the nose 24 moves with the bayonet 30 from its unlocked position (FIG. 6) to its locked position (FIG. 7). At the distal ends extending from the base 23 and the bayonet 30, the upper portion 42 and the lower portion 44 of the nose 24 slidingly engage one another to provide structural integrity for the locking device 20 in the locked configuration. As shown in FIGS. 10 and 11, a rail 46 extending upwardly from the lower portion 44 slidingly engages a slot 48 (FIG. 4) defined in the distal end of the upper portion 42 of the nose 24. For convenient terminology, the cover 21 of the housing 22 is described herein to define a proximal end 50 of the locking device 20 and the opposite end of the nose 24 is described herein to define a distal end 52 of the locking device.

For convenient access in unlocking the locking device 20, the cover 21 and the base 23 of the housing 22 each define open ends of the recess 28 so that the magnet 62 of the magnetic key 60 can be received within the recess from either side of the housing. In this manner, the locking device 20 can be readily unlocked (by inserting the magnet 62 into the recess 28) whether the locking device is oriented in the first orientation (FIG. 1 and FIG. 10) or the second orientation (FIG. 2 and FIG. 11). The magnetic key 60 preferably comprises a sliding actuator button 64 for extending the magnet 62, which is biased to return to a retracted position by a biasing spring (not shown) provided within the magnetic key when the actuator button is released. The magnet 62 is extended, as shown in FIGS. 1 and 2, by sliding the actuator button 64 toward the tapered end of the magnetic key 60. The recess 28 is sized and specially shaped to receive the magnet 62. As shown herein, the recess 28 is D-shaped. However, the recess 28 may have any desired shape that conforms to an irregular (i.e. uncommon) shape of the magnet 62. Indicia may be printed on or formed into the cover 21 and/or the base 23 of the housing 22 on each side of the recess 28 as shown herein to indicate that the recess is associated with the unlocking function of the locking device 20.

Preferably, the locking device 20 is configured to be reversible in that its orientation can be selected from one of two opposing orientations for use with the first merchandise display hook 10 in a first orientation, and for use with the second merchandise display hook 10' in a second orientation. It will be readily appreciated by those skilled in the art that the locking device 20 is usable with commonly available merchandise display hooks that have lower rods 12, 12' having different lengths relative to the upper rod 11. In particular, the locking device 20 is usable with a merchandise display hook 10 having an upper rod 11 and a lower rod 12 that is substantially the same length as the upper rod. At the same time, the locking device 20 is also usable with a merchandise display hook 10' having an upper rod 11 and a lower rod 12' that is shorter than the upper rod. As shown in FIG. 1 and FIG. 10, when the locking device 20 is locked onto the merchandise display hook 10 in the first orientation, the locking device can be positioned (i.e. slid outwardly) along the upper rod 11 and the lower rod 12 until the proximal end 50 abuts the turned out end portion 18 of the upper rod. Similarly, when the locking device 20 is locked onto the merchandise display hook 10' in the second orientation shown in FIG. 2 and FIG. 11, the locking device can be positioned (i.e. slid outwardly) along the upper 11 and the lower rod 12' until the distal end 52 of the locking device abuts the turned out end portion 18 of the upper rod. The reversibility of the locking device 20 permits the locking device to be used with a variety of common types of merchandise display hooks.

In particular, FIG. 1 and FIG. 10 illustrate a first common type of merchandise display hook 10 having an upper rod 11 and a lower rod 12 that extend outwardly from a display support (e.g. pegboard) to approximately the same length, while FIG. 2 and FIG. 11 illustrate a second common type of merchandise display hook 10' having an upper rod 11 that extends outwardly a further distance from the display support than the lower rod 12'. In other words, the upper rod 11 of the merchandise display hook 10' is longer in length than the lower rod 12'. The end portion 18 of the upper rod 11 of either display hook 10, 10' may be used to support a label, label holder or other informational element (e.g. product code, barcode, UPC, etc.). The end portions 18 also serve to prevent removal of the locking device 20 from either type of merchandise display hook 10, 10'. Accordingly, the end portions 18 serve to insure that the locking device 20 is securely locked on either type of the merchandise display hook 10, 10' and cannot be easily removed by manipulating the housing 22 past the upturned end portion 16 of the lower rod 12, 12' and around the turned out end portion 18 of the upper rod 11.

At the same time the locking device 20 is configured to maximize the product density on either type of merchandise display hook 10, 10'. The locking device 20, and more particularly the nose 24 of the locking device, allows the greatest number of the items of merchandise possible to be supported on the lower rod 12, 12' of the display hook 10, 10'. As illustrated in FIG. 10, wherein the locking device 20 is shown locked in the first orientation on the merchandise display hook 10 comprising upper rod 11 and lower rod 12 having substantially equal lengths, essentially the entire length of the lower rod is available to support items of merchandise. The nose 24 of the locking device 20 is spaced sufficiently from the lower rod 12 so as to permit items of merchandise to be supported along the lower rod from the horizontal mounting member 14 to the inwardly facing surface of the base 23 of the locking device. As illustrated in FIG. 11, wherein the locking device 20 is shown locked in the second orientation on the second merchandise display hook 10' comprising upper rod 11 and shorter lower rod 12', essentially the entire length of the lower rod 12' is again advantageously available to support items of merchandise. The nose 24 of the locking device 20 extends outwardly to abut the turned out portion 18 of the upper rod 11 while the housing 22 remains secured around the lower rod 12', thereby preventing the locking device from being removed from the display hook 10'. The length of the nose 24 is consumed by the additional length of the upper rod 11 so as to permit items of merchandise to be supported along the lower rod 12' from the horizontal mounting member 14 to the inwardly facing surface of the cover 21. Thus, the reversibility of the locking device 20 facilitates its use with either type of merchandise display hook 10, 10', while at the same time permitting use of essentially the entire length of the lower rod 12, 12' for supporting the greatest number of items of merchandise possible on the locked display hook.

The foregoing has described an exemplary embodiment of a locking device for a merchandise display hook. While a preferred embodiment of the present invention has been shown and described herein, it will be readily apparent to those skilled in the art that various modifications can be made thereto without departing from the spirit and scope of the invention. The foregoing description of the invention and the best mode for practicing the invention are provided for the purpose of illustration only, and not for the purpose of limitation. It is therefore envisioned that equivalent embodiments of the invention are well within the skill of an ordinary artisan without departing from the spirit and scope of the appended claims.

The invention claimed is:

1. A reversible locking device for merchandise display hooks comprising:

an upper rod defining a longitudinal axis;

a lower rod spaced apart from the upper rod and defining a longitudinal axis generally parallel to the longitudinal axis defined by the upper rod;

a housing defining an elongate first slot for receiving the upper rod and the lower rod therein, the first slot being fixed relative to the housing;

a nose depending from the housing in the direction of the longitudinal axis defined by the upper rod, the nose receiving the upper rod therein; and a lock movable between a locked position for locking the housing on the upper rod and the lower rod and an unlocked position for removing the housing from at least one of the upper rod and the lower rod;

wherein the housing is reversible relative to the upper rod and the lower rod so that the nose depends from the housing in a first direction for use on a first merchandise display hook and depends from the housing in a second direction opposite to the first direction for use on a second merchandise display hook.

2. A reversible locking device according to claim 1, wherein the first merchandise display hook comprises an upper rod and a lower rod having substantially the same length and wherein the second merchandise display hook comprises an upper rod and a lower rod that is shorter than the upper rod.

3. A reversible locking device according to claim 1, wherein the lower rod is spaced apart from the upper rod a predetermined distance and wherein the length of the first slot defined by the housing is greater than the predetermined distance.

4. A reversible locking device according to claim 1, wherein the housing defines a second slot and wherein the at least one of the upper rod and the lower rod is passed through the second slot with the lock in the unlocked position to remove the housing from the at least one of the upper rod and the lower rod.

5. A reversible locking device according to claim 4, wherein the lock comprises a bayonet that blocks access to the second slot in the locked position and permits access to the second slot in the unlocked position.

6. A reversible locking device according to claim 5, wherein the bayonet is biased by a biasing force towards the unlocked position.

7. A reversible locking device according to claim 5, wherein the lock further comprises a shuttle that engages the bayonet for retaining the bayonet in the locked position.

8. A reversible locking device according to claim 7, wherein the shuttle is biased by a biasing force towards the bayonet.

9. A reversible locking device according to claim 8, wherein the shuttle is made of a magnetically attractable material and further including a key comprising a magnet that attracts the shuttle against the biasing force away from the bayonet.

10. In combination:

a merchandise display hook having an upper rod defining a longitudinal axis and a lower rod disposed generally parallel to the longitudinal axis of the upper rod; and a reversible locking device comprising:

a housing having a first slot formed therethrough adapted to receive the upper rod and the lower rod of the merchandise display hook therein;

a bayonet disposed at least partially within the housing, the bayonet being movable between a locked position in which at least a portion of the bayonet extends into the first slot and thereby restricts movement of at least one of the upper rod and the lower rod within the slot, and an unlocked position in which the bayonet does not extend into the first slot and thereby permits movement of the upper rod and the lower rod within the first slot; and a nose depending outwardly from the housing in the direction of the longitudinal axis defined by the upper rod, the nose defining a channel that intersects the first slot of the housing, the channel being adapted to receive the upper rod of the merchandise display hook with the upper rod and the lower rod disposed within the first slot of the housing.

11. The combination according to claim 10, wherein the nose comprises:

an upper portion depending outwardly from the housing in the direction of the longitudinal axis defined by the upper rod; and a lower portion depending outwardly from the bayonet in the direction of the longitudinal axis defined by the upper rod, the lower portion slidably engaging the upper portion in the locked position with the upper rod disposed between the upper portion and the lower portion.

12. The combination according to claim 11, further comprising:

a shuttle disposed within the housing, the shuttle being movable between an engaging position in which the shuttle engages the bayonet and thereby prevents movement of the bayonet from the locked position, and a disengaging position in which the shuttle does not engage the bayonet and thereby permits the bayonet to move from the locked position to the unlocked position.

13. The combination according to claim 12, wherein the shuttle is biased towards the engaging position and wherein the bayonet is biased towards the unlocked position.

14. The combination according to claim 13, wherein the shuttle is made of a magnetically attractable material and further including a key comprising a magnet that attracts the shuttle from the engaging position in which the bayonet is retained in the locked position to the disengaging position in which the bayonet is released from the locked position and biased towards the unlocked position.

15. The combination according to claim 14, wherein the housing has a recess formed therein having a predetermined shape and wherein the magnet of the key has a complementary shape for being received within the recess.

16. The combination according to claim 10, wherein the nose is reversible in the direction of the longitudinal axis defined by the upper rod so that the reversible locking device is in a first orientation on a first type of the merchandise display hook and in a second orientation on a second type of the merchandise display hook.

17. The combination according to claim 16, wherein the first type of the merchandise display hook comprises an upper rod and a lower rod having substantially the same length and wherein the second type of the merchandise display hook comprises an upper rod and a lower rod that is shorter than the upper rod.

18. The combination according to claim 10, wherein the lower rod is spaced apart from the upper rod a predetermined distance and wherein the first slot of the housing has a length that is greater than the predetermined distance.

19. The combination according to claim 10, wherein the housing has a second slot and wherein the at least one of the upper rod and the lower rod is passed through the second slot with the bayonet in the unlocked position to remove the at least one of the upper rod and the lower rod from the reversible locking device.

20. The combination of a reversible locking device and a merchandise display hook having an upper rod and a lower rod spaced apart from the upper rod for supporting and displaying items of merchandise thereon, the locking device being configured to be reversibly disposed on the upper rod so that the locking device is usable in a first orientation with a first type of the merchandise display hook comprising an upper rod and a lower rod having substantially the same length and is usable in a second orientation opposite the first orientation with a second type of the merchandise display hook comprising an upper rod and a lower rod that is shorter than the upper rod, the locking device being reversible so as to maximize the number of the items of merchandise possible to be supported and displayed on both the first type of the merchandise display hook and the second type of the merchandise display hook, the locking device comprising a housing defining an elongate first slot for receiving the upper rod and the lower rod therein that is fixed relative to the housing and a second slot substantially perpendicular to the first slot that is closed in a locked position to prevent the locking device from being removed from the merchandise display hook and is open in an unlocked position to permit the locking device to be removed from the merchandise display hook.

* * * * *

UNITED STATES PATENT AND TRADEMARK OFFICE

CERTIFICATE OF CORRECTION

PATENT NO. : 8,286,454 B2
APPLICATION NO. : 12/718065
DATED : October 16, 2012
INVENTOR(S) : Justin A. Richardson et al.

It is certified that error appears in the above-identified patent and that said Letters Patent is hereby corrected as shown below:

In column 11, line 1, delete the phrase "possible to be".

Signed and Sealed this
Twenty-ninth Day of January, 2013

David J. Kappos

David J. Kappos
*Director of the United States Patent and Trademark Office*